US006136487A

United States Patent [19]

Shimizu et al.

[11] Patent Number: 6,136,487

[45] **Date of Patent: *Oct. 24, 2000**

[54] DEVELOPING METHOD

[75] Inventors: Tamotsu Shimizu, Settsu; Noboru Ito, Kawanishi; Yoshio Sakagawa, Ibaraki; Yoshiyuki Iguchi, Takarazuka, all of Japan

[73] Assignee: Minolta Co., Ltd., Osaka, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/818,790

[22] Filed: Mar. 14, 1997

[30] Foreign Application Priority Data

| | | | |
|---|---|---|---|
| Mar. 15, 1996 | [JP] | Japan | 8-087291 |
| Mar. 15, 1996 | [JP] | Japan | 8-087292 |
| Mar. 15, 1996 | [JP] | Japan | 8-087293 |

[51] Int. Cl.[7] ..... G03G 13/09

[52] U.S. Cl. ..... 430/100; 430/122

[58] Field of Search ..... 430/122, 100; 399/270, 267

[56] References Cited

U.S. PATENT DOCUMENTS

| | | | |
|---|---|---|---|
| 3,041,169 | 6/1962 | Wielicki | 430/100 |
| 4,374,191 | 2/1983 | Mukoh et al. | 430/100 |
| 5,688,622 | 11/1997 | Ito et al. | 430/122 |

FOREIGN PATENT DOCUMENTS

| | | |
|---|---|---|
| 61-032858 | 2/1986 | Japan . |
| 62-182760 | 8/1987 | Japan . |
| 5-323681 | 12/1993 | Japan . |
| 6-274041 | 9/1994 | Japan . |
| 7-117789 | 5/1995 | Japan . |

OTHER PUBLICATIONS

R.M. Schaffert, *Electrophotography*, Wiley & Sons, NY (1975) pp. 27–36 & 50–51.

*Primary Examiner*—Janis L. Dote
*Attorney, Agent, or Firm*—McDermott, Will & Emery

[57] ABSTRACT

In a developing method of exposing the surface of a charged image carrying member to form an electrostatic latent image on the surface of the image carrying member, while conveying a developer containing toners and carriers to a developing region opposite to the image carrying member having the electrostatic latent image formed thereon by a developer conveying member, and applying at least an AC voltage between the image carrying member and the developer conveying member in the developing region, to develop the electrostatic latent image formed on the image carrying member, the relationship among an initial surface potential V0 at the image carrying member, a surface potential Vir at an exposed portion of the image carrying member, a peak-to-peak value Vp–p of the AC voltage applied between the image carrying member and the developer conveying member in the developing region, and a distance Ds (mm) between the image carrying member and the developer conveying member in the developing region satisfies the following condition:

$$|V0-Vir|/(Vp-p/Ds)<0.08 \text{ (mm)}$$

7 Claims, 1 Drawing Sheet

DEVELOPING METHOD

BACKGROUND OF THE INVENTION

1. Field of the Invention

The present invention relates generally to a developing method of developing an electrostatic latent image formed on an image carrying member in an image forming apparatus such as a copying machine or a printer, and more particularly, a developing method of conveying a developer containing toners and carriers to a developing region opposite to the image carrying member by a developer conveying member and supplying the toners in the developer from the developer conveying member to the image carrying member in the developing region to carry out development.

2. Description of the Related Art

In an image forming apparatus such as a copying machine or a printer, various methods have been conventionally known as a developing method of supplying toners to a latent image formed on an image carrying member to carry out development. As a representative of such developing methods, a developing method so adapted as to expose the surface of a charged image carrying member to form an electrostatic latent image on the surface of the image carrying member, while conveying a developer containing toners and carriers to a developing region opposite to the image carrying member having the electrostatic latent image formed thereon in the state of a magnetic brush by a developer conveying member, bring the developer on the developer conveying member into contact with the surface of the image carrying member in the state of the magnetic brush in the developing region, and supply the toners in the developer from the developer conveying member to a latent image portion of the image carrying member to carry out development has been widely known.

In a case where the developer is thus brought into contact with the image carrying member in the state of the magnetic brush to carry out the development, however, there are some problems. For example, the toners supplied onto the image carrying member are scraped by the magnetic brush on the developer conveying member, so that a toner image formed on the image carrying member is distorted. Particularly in a case where toners in a plurality of colors are successively supplied to the image carrying member to carry out multicolor development, the toners in a color previously supplied to the image carrying member are scraped by the contact with the magnetic brush so that the image is distorted when the toners in the subsequent color are supplied to carry out the development, and the toners in the other color are independently mixed with the toners previously supplied Consequently, it is impossible to carry out good multicolor development in accurate colors.

The fact that the magnetic brush is hard because the magnetic force of the carriers in the developer is strong, and charges remaining on the carriers when the toners in the developer are supplied to the image carrying member, that is, so-called counter charges are considered the reason why the toner image formed on the image carrying member is distorted in a case where the developer is brought into contact with the image carrying member in the state of the magnetic brush to carry out the development.

Therefore, it has been conventionally considered that carriers having a low magnetic force are used as the carriers in the developer, and the bristles of the magnetic brush in contact with the image carrying member are softened, to prevent the toner image from being distorted by the contact of the magnetic brush.

When the carriers having a low magnetic force are thus used, however, the binding force of the carriers on the developer conveying member is weakened, so that the carriers are separated from the developer conveying member to easily adhere to the image carrying member. Particularly when an image having a high frequency such as a ladder pattern or an image such as a kanji character pattern formed with a large number of strokes is developed as an input image, the carriers adhering to the image carrying member are increased in number.

When the carriers thus adhere to the image carrying member, the carriers, together with the toner image, are transferred to paper, so that omissions due to the adhesion of the carriers occur in a formed image, and the image carrying member is damaged by the adhering carriers, causing some problems. For example, stripe-shaped noise or dot-shaped noise is produced in the formed image.

In recent years, in order to prevent the toner image formed on the image carrying member from being distorted by the magnetic brush formed of the developer as described above, a method of conveying a two-component developer containing toners and carriers to a developing region opposite to an image carrying member by a developer conveying member, exerting a oscillating electric field on the developing region, and supplying the toners in the developer from the developer conveying member to the image carrying member in a non-contact state where the developer is not brought into contact with the image carrying member, to carry out development has been developed, as disclosed in Japanese Patent Laid-Open No. 32858/1986, Japanese Patent Laid-Open No. 182760/1987, etc.

Even when the oscillating electric field is thus exerted on the developing region, and the toners in the developer are supplied to the image carrying member in a state where the developer is not brought into contact with the image carrying member, to carry out the development, however, counter charges remain on the carriers by the supply of the toners, and the carriers are attracted to the image carrying member by a wraparound electric field based on a potential difference between an exposed portion and an unexposed portion in the image carrying member, so that the carriers still adhere to the image carrying member. Further, an edge portion of an image is strongly developed by the wraparound electric field, whereby a lot of toners are supplied, so that the edge portion of the image is thickened or deepened.

In order to prevent the carriers from thus adhering to the image carrying member, a method of increasing the amount of a developer conveyed to an image carrying member by a developer conveying member to keep the consumption rate of toners in the developer low has been considered, as disclosed in Japanese Patent Laid-Open No. 323681/1993.

If the amount of the developer conveyed to the image carrying member by the developer conveying member is thus increased, however, in supplying the toners in the developer to the image carrying member upon exertion of a oscillating electric field on the developing region to carry out development as described above, the toners scattered without being supplied to the image carrying member are increased in number, causing some problems. For example, a formed image is fogged, and the inside of the apparatus such as the copying machine is contaminated by the scattered toners.

Furthermore, if the amount of the developer conveyed to the image carrying member by the developer conveying member is increased, a lot of charged toners in the developer are not used for the development, resulting in reduced development efficiency. Therefore, a lot of charged toners are returned to a developing device by the developer conveying member in a state where they are held in the carriers. Therefore, toners newly supplied and the carriers are not sufficiently mixed and agitated, so that the new toners are not sufficiently charged.

SUMMARY OF THE INVENTION

An object of the present invention is to provide a new and useful developing method in which the above-mentioned problems are solved.

Another object of the present invention is to provide a developing method in which a good image is stably obtained.

Still another object of the present invention is to provide a developing method in which a highly precise and good image is obtained.

Still another object of the present invention is to provide a developing method in which toners supplied onto an image carrying member are prevented from being scraped by a magnetic brush, to prevent a toner image from being distorted.

Still another object of the present invention is to provide a developing method in which carriers are prevented from adhering to an image carrying member, so that no omissions occur in an image, and an image carrying member is not damaged, to prevent stripe-shaped noise or dot-shaped noise from being produced.

Still another object of the present invention is to provide a developing method in which an image which is not fogged can be obtained by preventing an excess developer from being conveyed to a developing region to prevent toners from being scattered.

Still another object of the present invention is to provide a developing method in which toners are sufficiently charged, to prevent the toners from being Insufficiently charged.

A further object of the present invention is to provide a developing method in which an edge portion is prevented from being strongly developed, to prevent the edge portion from being thickened or deepened.

A still further object of the present invention is to provide a developing method in which a magnetic brush is not coarse, to prevent the reproduction of an image from being reduced.

In order to solve the above-mentioned problems, the present invention is directed to a developing method of exposing the surface of a charged image carrying member to form an electrostatic latent image on the surface of the image carrying member, while conveying a developer containing toners and carriers to a developing region opposite to the image carrying member having the electrostatic latent image formed thereon by a developer conveying member, and applying at least an AC voltage between the image carrying member and the developer conveying member in the developing region, to develop the electrostatic latent image formed on the image carrying member, wherein the development is carried out in such a manner that the relationship among an initial surface potential V0 at the image carrying member, a surface potential Vir at an exposed portion of the image carrying member, a peak-to-peak value Vp−p of an AC voltage applied between the image carrying member and the developer conveying member in the developing region, and a distance Ds (mm) between the image carrying member and the developer conveying member in the developing region satisfies the following condition:

$$|V0-Vir|/(Vp-p/Ds)<0.08 \text{ (mm)}$$

Furthermore, in order to solve the above-mentioned problems, the present invention is directed to a developing method of exposing the surface of a charged image carrying member to form an electrostatic latent image on the surface of the image carrying member, while conveying a developer containing toners and carriers to a developing region opposite to the image carrying member having the electrostatic latent image formed thereon by a developer conveying member, and supplying the toners in the developer from the developer conveying member to the image carrying member in the developing region, to carry out development, wherein the development is carried out in such a manner that the relationship among an amount per unit area M of the developer conveyed to the developing region by the developer conveying member, the bulk density P of the developer, and a distance Ds (mm) between the developer conveying member and the image carrying member which are opposite to each other in the developing region satisfies the following condition:

$$0.01 \leqq M/(P \cdot Ds) \leqq 0.30$$

Additionally, in order to solve the above-mentioned problems, the present invention is directed to a developing method of conveying a developer containing toners and carriers to a developing region opposite to an image carrying member in the state of a magnetic brush by a developer conveying member, and supplying the toners in the developer from the developing conveying member to the image carrying member, to carry out development, wherein the development is carried out on the condition that a coating rate A (%) at which the surface of the developer conveying member is coated with the magnetic brush formed of the developer in the developing region is in the range of $10\%<A<50\%$.

These and other objects, advantages and features of the invention will become apparent from the following description thereof taken in conjunction with the accompanying drawings which illustrate specific embodiment of the invention.

DESCRIPTION OF THE PREFERRED EMBODIMENTS

Figure 1:
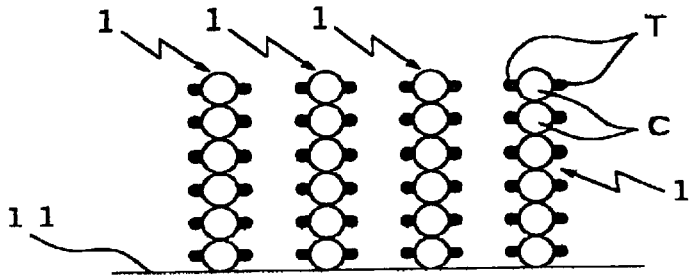
FIG. 1 is a partially enlarged illustration indicating that a coating rate is measured in a state where the surface, of a developer conveying member is coated with a raised magnetic brush formed of a developer.

The present Invention is directed to a developing method of conveying at least a developer containing toners and carriers to a developing region opposite to an image carrying member by a developer conveying member, and supplying the toners in the developer from the developer conveying member to the image carrying member in the developing region, to carry out development.

A latent image is formed on the image carrying member by a conventionally known method, for example, a method of exposing the surface of a charged image carrying member to form an electrostatic latent image on the surface of the image carrying member.

A developing bias voltage is applied between the image carrying member and a developer carrying member such as a developing sleeve, to exert an electric field on the developing region. Examples of the developing bias voltage include a DC voltage, an AC voltage, and a voltage obtained by superimposing a DC voltage on an AC voltage. Particularly when a oscillating electric field is exerted on the developing region, this is favorable to prevent the carriers from adhering to the image carrying member in supplying the toners in the developer from the developer conveying member to the image carrying member in the developing region to carry out the development.

It is preferable to carry out the development in such a manner that the relationship among an initial surface potential V0 at the image carrying member, a surface potential Vir at an exposed portion of the image carrying member, a peak-to-peak value Vp−p of the AC voltage applied between the image carrying member and the developing sleeve in the developing region, and a distance Ds (mm) between the image carrying member and the developing conveying member in the developing region satisfies the following condition:

$$|V0-Vir|/(Vp-p/Ds)<0.08 \text{ (mm)}$$

When the above-mentioned condition is satisfied, the exertion of a wraparound electric field is decreased by the decrease in a potential difference between the exposed portion and an unexposed portion in the image carrying member, so that the carriers are prevented from adhering to the image carrying member by the wraparound electric field. Further, a oscillating electric field in the developing region is strengthened, so that the effect of the wraparound electric field is relatively weakened. Consequently, the carriers adhering to the image carrying member at the time of the development are decreased in number. Therefore, omissions due to the adhesion of the carriers (hereinafter referred to as voids) hardly occur in a formed image, so that a good image is obtained.

If the value of |V0−Vir|/(Vp−p/Ds) is too low, the potential difference between the exposed portion and the unexposed portion in the image carrying member, that is, a potential difference between an image portion and a non-image portion is too small, whereby the development cannot be satisfactorily carried out. Further, the oscillating electric field exerted between the image carrying member and the developer conveying member in the developing region is too strong, and a leak occurs between the developer conveying member and the image carrying member, whereby the development cannot be carried out. Therefore, it is preferable to carry out the development in such a manner that the above-mentioned value of |V0−Vir|/(Vp−p/Ds) satisfies the following condition:

$$0.005 \text{ (mm)}<|V0-Vir|/(Vp-p/Ds)<0.08 \text{ (mm)}$$

Furthermore, if the amount of the developer conveyed by the developer conveying member is too large, the carriers adhering to the image carrying member are increased in number, whereby the number of voids in a formed image is increased On the other hand, if the amount of the developer conveyed is too small, an image having a sufficient image density is not obtained. Therefore, the amount of the developer conveyed to the developing region is set to preferably 0.7 to 10.0 mg/cm$^2$, and more preferably 0.7 to 5.0 mg/cm$^2$.

On the other hand, it is preferable to carry out the development in such a manner that the relationship among an amount per unit area M of the developer conveyed to the developing region by the developer conveying member, the bulk density P of the developer, and a distance Ds between the developer conveying member and the image carrying member which are opposite to each other in the developing region satisfies the following condition:

$$0.10 \leqq M/(P-Ds) \leqq 0.30$$

The setting of the condition eliminates the possibilities that the toners are scattered at the time of the development, the toners supplied to the image carrying member are scraped, a formed image is fogged and is distorted, resulting in reduced reproduction. Therefore, a good image superior in reproduction is obtained.

When the value of M/(P·Ds) is lower than 0.10, the developer conveyed to the developing region by the developer conveying member is brought into a coarse state, so that the toners in the developer may be easily scattered. When the value is higher than 0.30, the ratio of the developer in the developing region is increased, and the toners supplied to the image carrying member are scraped by the developer, whereby an image superior in reproduction may not be obtained.

Furthermore, when a oscillating developing bias voltage obtained by superimposing a DC voltage and an AC voltage is applied between the image carrying member and the developer conveying member in the developing region to carry out reversal development, it is preferable to carry out the development in such a manner that the relationship among a surface potential Vir (V) at the exposed portion of the image carrying member, a center voltage Vc (V) which is a value obtained by dividing a time integral value of a voltage waveform of the developing bias voltage by the period of the developing bias voltage, the frequency f (kHz) of the oscillating developing bias voltage, and a distance Ds (mm) between the image carrying member and the developer conveying member which are opposite to each other in the developing region satisfy the following condition:

$$50 \leqq |Vir-Vc|/(Ds \cdot f^2) \leqq 150$$

When the reversal development is carried out in such a manner that the condition of $50 \leqq |Vir-Vc|/(Ds \cdot f^2) \leqq 150$ is satisfied, the density of a formed image is prevented from being decreased, and an edge portion of the image is prevented from being strongly developed, whereby an image having a sufficient image density and being highly precise and superior in reproduction is obtained.

When the value of $|Vir-Vc|/(Ds \cdot f^2)$ is lower than 50, in supplying the toners in the developer from the developer conveying member to the image carrying member in the developing region, the degree of movement of the toners is decreased, whereby the density of a formed image is decreased, resulting in the possibility that a sufficient image density is not obtained. When the value of $|Vir-Vc|/(Ds \cdot f^2)$ is higher than 150, the degree of movement of the toners to the image carrying member is too high, whereby an edge portion of an image is strongly developed. Consequently, the edge portion of the image is thickened, and the density of the image is increased, whereby the edge effect is strongly produced, resulting in the possibility that the reproduction of a highly precise image is reduced.

When the oscillating developing bias voltage obtained by superimposing the DC voltage and the AC voltage is applied between the image carrying member and the developer conveying member in the developing region to carry out regular development, it is preferable to carry out the development in such a manner that the relationship among an initial surface potential V0 (V) at the image carrying member, a center voltage Vc (V) which is a value obtained by dividing a time integral value of a voltage waveform of the developing bias voltage by the period of the developing bias voltage, the frequency f (kHz) of the oscillating developing bias voltage, and a distance Ds (mm) between the image carrying member and the developer conveying member which are opposite to each other in the developing region satisfy the following condition:

$$50 \leqq |V0-Vc|/(Ds \cdot f^2) \leqq 150$$

When the regular development is carried out in such a manner that the condition of $50 \leqq |V0-Vc|/(Ds \cdot f^2) \leqq 150$ is satisfied, the density of a formed image is prevented from being decreased, and an edge portion of the image is prevented from being strongly developed, whereby an image having a sufficient image density and being highly precise and superior in reproduction is obtained.

When the value of $|V0-Vc|/(Ds \cdot f^2)$ is lower than 50, in supplying the toners in the developer from the developer conveying member to the image carrying member in the developing region, the degree of movement of the toners is decreased, whereby the density of a formed image is decreased, resulting in the possibility that a sufficient image density is not obtained, as in the case of the reversal development. When the value of $|V0-Vc|/(Ds \cdot f^2)$ is higher than 150, the degree of movement of the toners to the image carrying member is too high, whereby an edge portion of an image is strongly developed. Consequently, the edge portion of the image is thickened, and the density of the image is increased, whereby the edge effect is strongly produced, resulting in the possibility that the reproduction of a highly precise image is reduced.

Furthermore, in supplying the toners in the developer from the developer conveying member to the image carrying member in the developing region to carry out the development as described above, letting r ($\mu$m) be the average particle diameter of the carriers, Bc (Gauss) be the magnetic force of the carriers, and Bm (Gauss) be the magnetic force of a development magnetic pole in the developer conveying member, if the value of $r^3 \cdot Bc \cdot Bm$ is too low, the carriers easily adhere to the image carrying member at the time of the development. On the other hand, if the value is too high, the carriers aggregate, so that the magnetic brush formed of the developer on the developer conveying member becomes coarse. Therefore, the reproduction of a highly precise image is reduced, so that the quality of an obtained image is degraded. Consequently, it is preferable to satisfy the condition of $7 \times 10^8 \leqq r^3 \cdot Bc \cdot Bm \leqq 2 \times 10^{11}$.

On the other hand, it is preferable to convey the developer containing the toners and the carriers in the state of the magnetic brush to the developing region opposite to the image carrying member by the developer conveying member, supply the toners in the developer from the developer conveying member to the image carrying member to carry out the development, and carry out the development on the condition that a coating rate A (%) at which the surface of the developer conveying member is coated with the magnetic brush formed of the developer in the developing region is in the range of $10\% < A < 50\%$.

The coating rate A (%) is a coating rate at which the surface of a developer conveying member 11 is coated with a magnetic brush formed of a developer 1 containing toners T and carriers C in a state where the magnetic brush is raised on the surface of the developer conveying member 11. That is, letting A1 be the area of a surface, which is coated with the magnetic brush formed of the developer 1, of the developer conveying member 11, and letting A0 be the surface area of the developer conveying member, the coating rate A (%) is found by the following equation:

$$A(\%) = (A1/A0) \times 100$$

When the development is carried out in such a manner that the coating rate A (%) is $10\% < A < 50\%$ in the developing region, the toners are not scattered at the time of the development, whereby a fine-textured and highly precise image is obtained.

When the coating rate A is not more than 10% in the developing region, the magnetic brush formed of the developer on the surface of the developer conveying member is too coarse, whereby an image of fine texture may not be obtained. When the coating rate A is not less than 50% the magnetic brush formed of the developer on the surface of the developer conveying member is too dense, whereby the toners in the developer may be scattered in supplying the toners to the image carrying member as described above.

Furthermore, letting N ($/mm^2$) be the number of the bristles of the magnetic brush formed of the developer which exist per unit area on the surface of the developer conveying member in the above-mentioned developing region, and $\theta$ ($\theta 1/\theta 2$) be the ratio of the peripheral speed $\theta 1$ of the developer conveying member to the peripheral speed $\theta 2$ of the image carrying member , when the value of $N \cdot \theta$ is too low, the relative number of the bristles of the magnetic brush per unit area of the image carrying member is decreased, so that the reproduction of an image of fine texture is degraded. On the other hand, when the value of $N \cdot \theta$ is too high, the relative number of the bristles of the magnetic brush per unit area of the image carrying member is too large, so that a lot of toners are scattered at the time of the development. Therefore, it is preferable to carry out the development in such a manner that the value of $N \cdot \theta$ is in the range of $9/mm^2 \leqq N \cdot \theta \leqq 90/mm^2$.

Furthermore, in the above-mgntioned developing region, letting h (mm) be the average height of the magnetic brush formed of the developer on the surface of the developer conveying member, and A2 ($mm^2$) be the area of a portion where the bristles of the magnetic brush formed of the developer do not exist per square millimeter on the surface of the developer conveying member, when the value of $h \cdot A2$ is too low, the area occupied by the magnetic brush formed of the developer in the developing region is too large, so that the toners are scattered at the time of the development. On the other hand, when the value of $h \cdot A2$ is too high, the area occupied by the magnetic brush formed of the developer in the developing region is too small, so that the magnetic brush is too coarse, whereby the reproduction of a fine-textured and highly precise image is reduced. Therefore, it is preferable to carry out the development in such a manner that the value of $h \cdot A2$ is in the range of $0.15\ mm^3 < h \cdot A2 < 0.60\ mm^3$.

Although the developer is not particularly limited, a conventionally known two-component developer containing toners and carriers may be used. Particularly, It is preferable to use binder-type carriers.

Furthermore, if the magnetic force of the carriers in the developer is too strong, and the particle diameter thereof is too large, in conveying the same amount of developer to the developing region by the developer conveying member, the magnetic brush becomes coarse because the number of the bristles of the magnetic brush on the developer conveying member is decreased, whereby the reproduction of a highly precise image is degraded. On the other hand, if the magnetic force of the carriers is too weak, and the particle diameter thereof is too small, the carriers are not sufficiently held on the developer conveying member. Therefore, the number of carries adhering to the image carrying member is increased, so that the number of voids is increased in the formed image. As the above-mentioned carriers, it is generally more preferable to use binder-type carriers containing magnetic powder in binder resin than ferrite-type carriers. Examples of the carriers include carriers having a magnetic force of 800 to 3000 Gauss, and having an average particle diameter of not more than 50 μm, preferably 10 to 50 μm, more preferably 10 to 40 μm, and still more preferably 10 to 30 μm.

Furthermore, if there exist a lot of carriers having a particle diameter which is not more than the half of the average particle diameter of the carriers out of the carriers, the number of carriers adhering to the image carrying member is increased. Therefore, it is preferable that carriers having a particle diameter which is not more than the half of the average particle diameter of the carriers are not more than 5% by weight per all the carriers.

Embodiments of the developing method according to the present invention will be specifically described on the basis of the attached drawings.

First Embodiment

Figure 2:
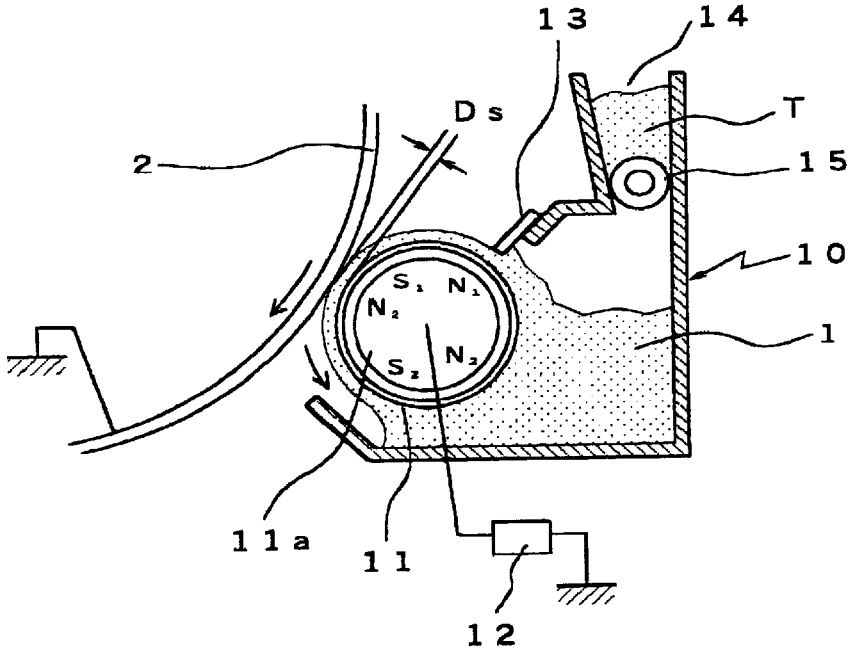
FIG. 2 is a schematic illustration showing one example of a developing device used to carry out a developing method according to the present invention.

One example of a developing device in a first embodiment used for carrying out the developing method according to the present invention will be specifically described on the basis of FIG. 2.

In a developing device 10, a developer 1 containing toners T and carriers is contained inside thereof, a cylindrical-shaped developing sleeve 11 having a magnet roller 11*a* having a plurality of magnetic poles N1, S1, N2, S2 and N3 provided on the side of its inner periphery is used as a developer conveying member 11 for conveying the developer 1, and the developing sleeve 11 is rotatably arranged so as to be opposed to a photoreceptor 2 which is an image carrying member 2 at a suitable distance Ds in a developing region, as shown in FIG. 2.

The developing sleeve 11 is so rotated as to be moved in the opposite direction to the photoreceptor 2, that is, in the same direction as the photoreceptor 2 in the developing region where the developing sleeve 11 and the photoreceptor 2 are opposite to each other, to convey the developer 1 contained in the developing device 10 toward the photoreceptor 2 in the state of a magnetic brush by a magnetic action exerted by the magnet roller 11*a* as the developing sleeve 11 is rotated.

Furthermore, a developing bias power supply 12 is connected to the developing sleeve 11. A DC voltage, an AC voltage, or a developing bias voltage obtained by superimposing an AC voltage and a DC voltage is applied from the developing bias power supply 12, to exert an electric field on the developing region.

In a position opposite to the magnetic pole N1 of the magnet roller 11*a* on the upstream side in the direction of conveyance of the developer 1 from the developing region where the developing sleeve 11 and the photoreceptor 2 are opposite to each other, a magnetic blade 13 is provided at a required distance from the developing sleeve 11. The amount of the developer 1 on the developing sleeve 11 is regulated by the magnetic blade 13.

Furthermore, in the developing device 10, a toner containing section 14 containing the toners T is provided in its upper part. The toners T in the developer 1 are supplied to the photoreceptor 2 from the developing sleeve 11, to carry out development. As a result, when the density of the toners in the developer 1 in the developing device 10 is reduced, a toner supplying roller 15 provided under the toner containing section 14 is rotated, to supply the toners T contained in the toner containing section 14 to the developer 1 in the developing device 10.

In the developing device 10, the surface of the photoreceptor 2 is charged by a charger (not shown), after which the surface of the photoreceptor 2 which is thus charged is exposed by suitable exposing means (not shown), to form an electrostatic latent image on the surface of the photoreceptor 2. On the other hand, the developer 1 is conveyed toward the photoreceptor 2 in the state of a magnetic brush by the developing sleeve 11, to regulate the amount of the developer 1 on the developing sleeve 11 by the magnetic blade 13 provided on the upstream side in the direction of conveyance of the developer 1 from the developing region where the developing sleeve 11 and the photoreceptor 2 are opposite to each other. The developer 1 thus regulated is conveyed to the developing region opposite to the photoreceptor 2 by the developing sleeve 11, a developing bias voltage is applied from the developing bias power supply 12, to exert a oscillating electric field on the developing region, so that the toners T in the developer 1 conveyed by the developing sleeve 11 are supplied to a latent image portion of the photoreceptor 2 from the developing sleeve 11, to carry out development.

In the developing method according to the present embodiment, in carrying out the development using the developing device 10, the development is carried out in such a manner that an initial surface potential V0 at the photoreceptor 2, a surface potential Vir at an exposed portion of the photoreceptor 2, a peak-to-peak value Vp−p of an AC voltage applied between the photoreceptor 2 and the developing sleeve 11 from the developing bias power supply 12, and a distance Ds between the photoreceptor 2 and the developing sleeve 11 in the developing region are suitably adjusted, to satisfy the condition of $|V0-Vir|/(Vp-p/Ds) < 0.08$ (mm).

When the development is carried out under the condition, the toners T in the developer 1 conveyed to the developing region opposite to the photoreceptor 2 by the developing sleeve 11 are sufficiently supplied to the latent image portion of the photoreceptor 2, and the carriers in the developer 1 hardly adhere to the photoreceptor 2, so that the number of voids occurring in a formed image is significantly decreased.

Second Embodiment

In a developing method according to the present embodiment, in carrying out development using the developing device 10 described in the above-mentioned first embodiment, the development is carried out in such a manner that an amount per unit area M of a developer 1 conveyed to the developing region by the developing sleeve 11, the bulk density P of the developer 1, and a distance Ds between the developing sleeve 11 and the photoreceptor 2 which are opposite to each other in the developing region are suitably adjusted, to satisfy the condition of $0.10 \leqq M/(P \cdot Ds) \leqq 0.30$.

When the development is thus carried out, few toners T are scattered at the time of the development, and the toners T supplied to the photoreceptor 2 are not scraped by the developer 1 on the developing sleeve 11, so that a formed image is not fogged and is not distorted, whereby a good image superior in reproduction is obtained.

Third Embodiment

In a developing method according to the present embodiment, in carrying out development using the developing device 10 described in the above-mentioned first embodiment, the development is carried out in such a manner that a coating rate A (%) at which the surface of the developing sleeve 11 is coated with a magnetic brush formed of a developer 1 in the developing region is in the range of $10\% < A < 50\%$.

When the development is thus carried out, few toners T are scattered at the time of the development, and a fine-textured and highly precise image is obtained.

In the developing device 10, an experiment in which the conditions of an initial surface potential V0 at the photoreceptor 2, a surface potential Vir at an exposed portion of the photoreceptor 2, a peak-to-peak value Vp−p of an AC voltage applied between the photoreceptor 2 and the developing sleeve 11 from the developing bias power supply 12, and a distance Ds between the photoreceptor 2 and the developing sleeve 11 in the developing region are changed, an experiment in which the development conditions in the developing device 10 are changed, and an experiment in which the state of the magnetic brush formed of the developer 1 conveyed to the developing region by the developing sleeve 11 is changed in the developing device 10 are conducted, to make it clear that a good image is obtained when the development is carried out under the conditions described in the present invention.

EXPERIMENTAL EXAMPLE 1

In this experimental example, carriers and toners produced in the following manner were used as a developer.

Binder-type carriers having an average particle diameter of 25 μm which were obtained by mixing 100 parts by weight of styrene-acrylic resin (Mw=200000, Mn=8000, Tg=58° C.) and 500 parts by weight of ferrite having a saturated magnetic force of 70 emu/g by a Henschel mixer, melting and kneading an obtained mixture by a biaxial extruder and cooling the kneaded mixture, then roughly pulverizing the kneaded mixture, further finely pulverizing the kneaded mixture by a jet mill, and classifying the kneaded mixture by an air classifier were used as the carriers.

On the other hand, negatively chargeable toners having an average particle diameter of 6 am which were obtained by mixing 100 parts by weight of polyester resin (Mw=250000, Mn=7500), 5 parts by weight of carbon black (MA#8 manufactured by Mitsubishi Chemical Industries, Ltd.), 2.5 parts by weight of wax (BISCOLE 550P manufactured by Sanyo Kasei Co., Ltd.), and 2 parts by weight of a charge control agent (S-34 manufactured by Orient Kagaku Co., Ltd.) by a Henschel mixer, melting and kneading an obtained mixture by a biaxial extruder and cooling the kneaded mixture, then roughly pulverizing the kneaded mixture, further finely pulverizing the kneaded mixture by a jet mill, and classifying the kneaded mixture by an air classifier ware used as the toners.

In carrying out development using the above-mentioned developing device 10, a developer 1 containing 15% by weight of toners which was obtained by mixing the carriers and the toners was used. The amount of-the developer 1 conveyed to the developing region opposite to the photoreceptor 2 by the developing sleeve 11 was set to 4.5 mg/cm$^2$, and the peripheral speed of the developing sleeve 11 was set to 1.8 times the peripheral speed of the photoreceptor 2.

Furthermore, an initial surface potential V0 at the photoreceptor 2 was changed in the range of −200 to −700 V, while a surface potential Vir at an exposed portion of the photoreceptor 2 was set to −100 V, to set a value A1 (V) of |V0−Vir| to 100 V, 200 V, 300 V, 400 V, 500 V, and 600 V as shown in the following Table 1. On the other hand, a DC voltage Vb was adjusted to a value between V0 and Vir and was applied from the developing bias power supply 12, and an AC pulse voltage having a frequency of 3 kHz and having a peak-to-peak value Vp−p (V) in the range of 0.3 to 3.5 kV was applied as an AC voltage. Further, a distance Ds (mm) between the developing sleeve 11 and the photoreceptor 2 in the developing region was set to 0.3 mm and 0.5 mm as shown in the following Table 1, to change a value A2 (kV/mm) of Vp−p/Ds and a value A (mm) of |V0−Vir|/(Vp−p/Ds) as shown in the Table 1.

Reversal development was carried out using a commercially available copying machine (Di30 manufactured by Minolta Co., Ltd.) under the foregoing conditions, to copy a half image in a character memory mode of A4 size. The number of voids occurring in an obtained image of A4 size was measured. The results are shown in the Table 1.

TABLE 1

| A1 (V) | Ds (mm) | A2 (kV/mm) | A = A1/A2 (mm) | number of voids (/A4) |
|---|---|---|---|---|
| 100 | 0.5 | 1 | 0.100 | 12 |
| | 0.3 | 1.6 | 0.063 | 7 |
| | 0.5 | 2 | 0.050 | 5 |
| | 0.5 | 3 | 0.033 | 1 |
| | 0.3 | 3.3 | 0.030 | 0 |
| | 0.5 | 4 | 0.025 | 0 |
| | 0.3 | 5 | 0.020 | 0 |
| | 0.5 | 5 | 0.020 | 0 |
| | 0.5 | 6 | 0.017 | 0 |
| | 0.3 | 6.6 | 0.015 | 0 |
| | 0.5 | 7 | 0.014 | 0 |
| 200 | 0.3 | 1.6 | 0.125 | 27 |
| | 0.5 | 2 | 0.100 | 16 |
| | 0.5 | 3 | 0.066 | 6 |
| | 0.3 | 3.3 | 0.060 | 5 |
| | 0.5 | 4 | 0.050 | 2 |
| | 0.3 | 5 | 0.040 | 1 |
| | 0.5 | 5 | 0.040 | 0 |
| | 0.5 | 6 | 0.033 | 0 |
| | 0.3 | 6.6 | 0.030 | 0 |
| | 0.5 | 7 | 0.029 | 0 |
| 300 | 0.5 | 3 | 0.100 | 25 |
| | 0.3 | 3.3 | 0.090 | 16 |
| | 0.5 | 4 | 0.075 | 7 |
| | 0.3 | 5 | 0.060 | 3 |
| | 0.5 | 5 | 0.060 | 2 |
| | 0.5 | 6 | 0.050 | 1 |
| | 0.3 | 6.6 | 0.045 | 0 |
| | 0.5 | 7 | 0.043 | 0 |
| 400 | 0.5 | 4 | 0.100 | 28 |
| | 0.3 | 5 | 0.080 | 13 |
| | 0.5 | 5 | 0.080 | 10 |
| | 0.5 | 6 | 0.067 | 4 |
| | 0.3 | 6.6 | 0.060 | 2 |
| | 0.5 | 7 | 0.057 | 1 |
| 500 | 0.3 | 5 | 0.100 | 35 |
| | 0.5 | 5 | 0.100 | 33 |
| | 0.5 | 6 | 0.083 | 14 |
| | 0.3 | 6.6 | 0.075 | 2 |
| | 0.6 | 7 | 0.071 | 1 |
| 600 | 0.5 | 6 | 0.100 | 50 |
| | 0.3 | 6.6 | 0.090 | 26 |
| | 0.5 | 7 | 0.086 | 17 |

As a result, when the development was carried out on the condition that the value A of |V0−Vir|/(Vp−p/Ds) is not less than 0.080 (mm), the number of voids occurring in the obtained image of A4 size was not less than 10. On the other hand, when the development was carried out on the condition that the value A of |V0−Vir|/(Vp−p/Ds) is less than 0.080 (mm), the number of voids occurring in the obtained image of A4 size was less than 10, whereby a good image having a small number of voids was obtained.

EXPERIMENTAL EXAMPLE 2

In this experimental example, the carriers used in the above-mentioned experimental example 1 were changed, to use carriers (1) to (6) each having a particle diameter, true specific gravity, and a magnetic force shown in the following Table 2. A developer 1 containing 15% by weight of toners which was obtained by mixing each of the carriers (1) to (6) and the above-mentioned toners was used.

TABLE 2

| carrier | 1 | 2 | 3 | 4 | 5 | 6 |
|---|---|---|---|---|---|---|
| particle diameter (μm) | 20 | 30 | 15 | 60 | 70 | 35 |
| true specific gravity | 2.4 | 2.4 | 3.38 | 3.38 | 3.38 | 3.47 |
| magnetic force (G) | 1050 | 1050 | 2300 | 2300 | 2300 | 3000 |

In this experimental example, a distance Ds (mm) between the developing sleeve 11 and the photoreceptor 2 in the developing region was set to 0.3 mm, a value A2 (kV/mm) of Vp−p/Ds and a value A (mm) of |V0−Vir|/(Vp−p/Ds) were changed as shown in the following Table 3, as in the experimental example 1. Reversal development was carried out under the respective conditions as in the experimental example 1, to copy a half image in a character memory mode of A4 size. The number of voids occurring in an obtained image of A4 size was measured. The results are also shown in the Table 3.

TABLE 3

| A2 | A | number of voids (/A4) carrier | | | | | |
|---|---|---|---|---|---|---|---|
| (kV/mm) | (mm) | 1 | 2 | 3 | 4 | 5 | 6 |
| 3.5 | 0.07 | 5 | 4 | 4 | 3 | 3 | 4 |
| | 0.08 | 13 | 13 | 12 | 11 | 10 | 11 |
| | 0.09 | 25 | 20 | 21 | 22 | 20 | 20 |
| 5.0 | 0.07 | 6 | 5 | 4 | 4 | 3 | 5 |
| | 0.08 | 15 | 13 | 12 | 11 | 10 | 11 |
| | 0.09 | 26 | 24 | 21 | 20 | 20 | 22 |
| 6.5 | 0.07 | 5 | 5 | 5 | 4 | 3 | 4 |
| | 0.08 | 13 | 12 | 11 | 10 | 10 | 11 |
| | 0.09 | 25 | 22 | 21 | 21 | 20 | 22 |

As a result, even in a case where the type of carriers was changed as in the experimental example 2, when the development was carried out on the condition that the value A of |V0−Vir|/(Vp−p/Ds) is not less than 0.08 (mm), the number of voids occurring in the obtained image of A4 size was not less than 10, as in the experimental example 1. On the other hand, when the development was carried out on the condition that the value A of |V0−Vir|/(Vp−p/Ds) is less than 0.080 (mm), the number of voids occurring in the obtained image of A4 size was less than 10, whereby a good image having a small number of voids was obtained.

EXPERIMENTAL EXAMPLE 3

In this experimental example, a developer 1 containing 16% by weight of toners which was obtained by mixing the above-mentioned carriers (1) having an average particle diameter of 20 μm and having a magnetic force of 1050 G and the above-mentioned toners was used.

The amount of the developer 1 conveyed by the developing sleeve 11 was changed in the range of 3 to 20 mg/cm$^2$ as shown in the following Table 4. On the other hand, the peripheral speed of the developing sleeve 11 was set to 1.8 times the peripheral speed of the photoreceptor 2, an initial surface potential V0 at the photoreceptor 2 was set to −450 V, a surface potential Vir at an exposed portion of the photoreceptor 2 was set to −100 V, and a distance Ds between the photoreceptor 2 and the developing sleeve 11 in the developing region was set to 0.5 mm. A DC voltage Vb of −350 V and an AC pulse voltage having a frequency of 3 kHz and having a peak-to-peak value Vp−p of 2.4 kV were applied from the developing bias power supply 12, to copy a half image in a character memory mode of A4 size by reversal development, as in the above-mentioned experimental examples. The number of voids occurring in an obtained image of A4 size was measured. The results are also shown in the Table 4.

TABLE 4

| | amount of conveyed developer (mg/cm$^2$) | | | | | | | | |
|---|---|---|---|---|---|---|---|---|---|
| | 3 | 4 | 5 | 7.5 | 10 | 12 | 15 | 17 | 20 |
| number of voids (/A4) | 0 | 0 | 0 | 5 | 7 | 20 | 40 | 80 | 110 |

As a result, when the development was carried out on the condition that the amount of the developer 1 conveyed to the developing region by the developing sleeve 11 is set to more than 10 mg/cm$^2$, the number of voids occurring in the obtained image of A4 size was not less than 10, and the number of voids was rapidly increased as the amount of the developer 1 conveyed was increased. On the other hand, when the development was carried out on the condition that the amount of the developer 1 conveyed to the developing region is set to not more than 10 mg/cm$^2$, the number of voids occurring in the obtained image of A4 size was less than 10, whereby a good image having a small number of voids was obtained.

EXPERIMENTAL EXAMPLE 4

In this experimental example, binder-type carriers and ferrite-type carriers respectively having particle diameters shown in the following Table 5 were used as carriers. A developer 1 containing 15% by weight of toners which was obtained by mixing each of the carriers and the above-mentioned toners was used.

The amount of the developer 1 conveyed to the developing region opposite to the photoreceptor 2 by the developing sleeve 11 was set to 4.5 mg/cm$^2$, the peripheral speed of the developing sleeve 11 was set to 1.8 times the peripheral speed of the photoreceptor 2. An initial surface potential V0 at the photoreceptor 2 was set to −450 V, a surface potential Vir at an exposed portion of the photoreceptor 2 was set to −100 V, and a distance Ds between the photoreceptor 2 and the developing sleeve 11 in the developing region was set to 0.5 mm. A DC voltage Vb of −350 V and an AC pulse voltage having a frequency of 3 kHz and having a peak-to-peak value Vp−p of 2.4 kV were applied from the developing bias power supply 12, to carry out reversal development. The texture of each of obtained images was evaluated. The results are also shown in the Table 5. With respect to the texture, the obtained image was visually evaluated. The texture is indicated by 5 when it is fine and very smooth, 4 when it is slightly smooth, 3 when it is normal, 2 when it is slightly coarse, and 1 when it is very coarse.

TABLE 5

| particle diameter | binder-type carrier | | | | ferrite-type carrier | | |
|---|---|---|---|---|---|---|---|
| (μm) | 35 | 40 | 50 | 60 | 40 | 50 | 60 |
| texture | 5 | 4 | 3.5 | 2.5 | 2.5 | 2 | 1.5 |

As a result, in obtaining an image of fine texture, it was preferable to use the binder-type carriers as the carriers used in the developer 1. Even when the binder-type carriers were used, it was preferable to use binder-type carriers having a particle diameter of not more than 50 μm.

EXPERIMENTAL EXAMPLE 5

In this experimental example, carriers and toners produced in the following manner were used as a developer.

Binder-type carriers having an average particle diameter of 30 μm which were obtained by mixing 100 parts by weight of styrene-acrylic resin (Mw=200000, Mn=8000, Tg=58° C.) and 400 parts by weight of ferrite having a saturated magnetic force of 70 emu/g by a Henschel mixer, melting and kneading an obtained mixture by a biaxial extruder and cooling the kneaded mixture, then roughly pulverizing the kneaded mixture, further finely pulverizing the kneaded mixture by a jet mill, and classifying the kneaded mixture by an air classifier were used as the carriers. The magnetic force of the carriers was 2000 Gauss, and the resistance value thereof was $1.0\times10^{13}$ Ω·cm.

On the other hand, negatively chargeable toners having an average particle diameter of 6 μm which were obtained by mixing 100 parts by weight of polyester resin (Mw=250000, Mn=7500), 5 parts by weight of carbon black (MA#8 manufactured by Mitsubishi Chemical Industries, Ltd.), 2.5 parts by weight of wax (BISCOLE 550P manufactured by Sanyo Kasei Co., Ltd.), and 2 parts by weight of a charge control agent (S-34 manufactured by Orient Kagaku Co., Ltd.) by a Henschel mixer, melting and kneading an obtained mixture by a biaxial extruder and cooling the kneaded mixture, roughly pulverizing the kneaded mixture, further finely pulverizing the kneaded mixture by a jet mill, and classifying the kneaded mixture by an air classifier were used as the toners.

In this experimental example, in carrying out development using the above-mentioned developing device 10, a developer 1 containing 20% by weight of toners and having a bulk density of 0.94 g/cm$^3$ which was obtained by mixing the carriers and the toners was used. The peripheral speed of the developing sleeve 11 was set to three times the peripheral speed of the photoreceptor 2, an initial surface potential V0 at the photoreceptor 2 was set to −650 V, a surface potential Vir at an exposed portion of the photoreceptor 2 was set to −100 V, and a DC voltage Vb applied from the developing bias power supply 12 was set to −550 V.

Furthermore, in this experimental example, an amount per unit area M of the developer 1 conveyed to the developing region opposite to the photoreceptor 2 by the developing sleeve 11 was changed in the range of 2.8 to 28.2 mg/cm$^2$, a distance Ds between the developing sleeve 11 and the photoreceptor 2 which are opposite to each other in the developing region was changed in the range of 0.2 to 0.6 mm, as shown in the following Table 6, and a value of M/(P·Ds)×100 was changed as shown in the Table 6, to carry out reversal development under the foregoing conditions. Line copy reproduction in an obtained image was evaluated, and the weight of toners scattered at the time of the development was found. The results are also shown in the Table 6.

With respect to the line copy reproduction, 25 types of originals each obtained by respectively selecting the thicknesses of the vertical line and the horizontal line of a cross-shaped image out of 200 μm, 300 μm, 400 μm, 500 μm, and 700 μm and combining the selected lines were copied, to obtain first copies. The first copies were further copied, to obtain second copies. The second copy with respect to each of the 25 originals was copied four times, to obtain a total of 100 third copies. Breaks in a cross portion of the cross-shaped image in the copy were examined. The line copy reproduction is indicated as 5 when the number of third copies having no breaks is 80 to 100, 4 when it is 60 to 79, 3 when it is 40 to 59, 2 when it is 20 to 39, and 1 when it is 0 to 19. Further, with respect to the scattering of the toners, the weight of the toners scattered while the image was formed 1000 times was found.

TABLE 6

| M (mg/cm$^2$) | Ds (mm) | M/(P · Ds) × 100 | line copy reproduction rank | weight of scattered toner (mg/1000 times) |
|---|---|---|---|---|
| 18.8 | 0.4 | 50 | 1 | 3 |
| 28.2 | 0.6 | 50 | 1 | 3 |
| 18.8 | 0.4 | 44 | 2 | 2 |
| 11.3 | 0.3 | 40 | 2 | 5 |
| 22.5 | 0.6 | 40 | 2 | 6 |
| 10.2 | 0.3 | 38 | 2 | 3 |
| 5.6 | 0.2 | 30 | 3 | 2 |
| 11.3 | 0.4 | 30 | 3 | 5 |
| 10.2 | 0.4 | 27 | 3 | 3 |
| 10.6 | 0.5 | 22.5 | 4 | 4 |
| 4.9 | 0.3 | 17.5 | 4 | 3 |
| 8.2 | 0.5 | 17.5 | 4 | 6 |
| 9.9 | 0.6 | 17.5 | 4 | 5 |
| 5.6 | 0.6 | 10 | 5 | 6 |
| 4.5 | 0.6 | 8 | 5 | 10 |
| 2.8 | 0.6 | 5 | 5 | 22 |

As a result, when the value of M/(P·Ds) was more than 0.30, the line copy reproduction was evaluated as not more than 2, so that the reproduction of the image was degraded. On the other hand, when the value of M/(P·Ds) was less than 0.10, the weight of the scattered toners was rapidly increased. Contrary to this, when the development was carried out under the condition of $0.10 \leqq (P\cdot Ds) \leqq 0.30$ as shown in the present invention, few toners were scattered, whereby an image superior in line copy reproduction was obtained.

EXPERIMENTAL EXAMPLE 6

Also in this experimental example, the same toners and carriers as those in the above-mentioned experimental example 5 were used as toners and carriers in a developer. In carrying out development using the above-mentioned developing device 10, a developer 1 containing 20% by weight of toners and having a bulk density of 0.94 g/cm$^3$ which was obtained by mixing the carriers and the toners was used. The peripheral speed of the developing sleeve 11 was set to three times the peripheral speed of the photoreceptor 2, an initial surface potential V0 at the photoreceptor 2 was set to −650 V, and a surface potential Vir at an exposed portion of the photoreceptor 2 was set to −100 V. On the other hand, in applying a developing bias voltage from the developing bias power supply 12, a DC voltage Vb was set to −350 V, and a developing bias voltage obtained by superimposing an AC pulse voltage having a frequency of 3 kHz, having a duty ratio (development:recovery) of 1:1 and having a peak-to-peak value Vp−p of 1.2 kV on the DC voltage Vb was applied. In this case, the AC power voltage having a duty ratio (development:recovery) of 1:1 was used as an AC voltage applied from the developing bias power supply 12, whereby a center voltage Vc which is a value obtained by dividing a time integral value of a voltage waveform of the developing bias voltage by the period of the developing bias voltage and the DC voltage Vb coincide with each other (Vc=Vb).

Also in this experimental example, an amount per unit area M of the developer 1 conveyed to the developing region opposite to the photoreceptor 2 by the developing sleeve 11 was changed in the range of 2.8 to 28.2 mg/cm$^2$, a distance Ds between the developing sleeve 11 and the photoreceptor 2 which are opposite to each other in the developing region was changed in the range of 0.2 to 0.6 mm, as shown in the following Table 7, and a value of M/(P·Ds)×100 was changed as shown in the Table 7, to carry out reversal development under the foregoing conditions. Line copy reproduction in an obtained image was evaluated, and the weight of toners scattered at the time of the development was found in the same manner as that in the above-mentioned experimental example 5. The results are also shown in the Table 7.

TABLE 7

| M (mg/cm$^2$) | Ds (mm) | M/(P · Ds) × 100 | line copy reproduction rank | weight of scattered toner (mg/1000 times) |
|---|---|---|---|---|
| 18.8 | 0.4 | 50 | 2 | 4 |
| 28.2 | 0.6 | 50 | 2 | 5 |
| 27.9 | 0.4 | 47.5 | 2 | 5 |
| 16.0 | 0.4 | 42.5 | 3 | 4 |
| 21.4 | 0.6 | 38 | 3 | 9 |
| 10.2 | 0.3 | 36 | 3 | 5 |
| 9.3 | 0.3 | 33 | 4 | 5 |
| 5.6 | 0.2 | 30 | 4 | 5 |
| 11.3 | 0.4 | 30 | 4 | 7 |
| 4.7 | 0.2 | 25 | 5 | 5 |
| 9.4 | 0.4 | 25 | 5 | 6 |
| 11.8 | 0.5 | 25 | 5 | 5 |
| 14.1 | 0.6 | 25 | 5 | 7 |
| 5.6 | 0.3 | 20 | 5 | 5 |
| 9.4 | 0.5 | 20 | 5 | 7 |
| 11.3 | 0.6 | 20 | 5 | 7 |
| 4.9 | 0.3 | 17.5 | 5 | 8 |
| 8.2 | 0.5 | 17.5 | 5 | 9 |
| 9.9 | 0.6 | 17.5 | 5 | 9 |
| 4.2 | 0.3 | 15 | 5 | 6 |
| 8.5 | 0.6 | 15 | 5 | 8 |
| 5.6 | 0.6 | 10 | 5 | 9 |
| 4.5 | 0.6 | 8 | 5 | 25 |
| 2.8 | 0.6 | 5 | 5 | 40 |
| 1.7 | 0.6 | 3 | 5 | 50 |

As a result, when the developing bias voltage obtained by superimposing the AC voltage on the DC voltage was applied from the developing bias power supply 12 as in this experimental example, the line copy reproduction may, in some cases, be evaluated as not less than 3 even when the value of M/(P·Ds) is more than 0.30, so that the line copy reproduction was improved, as compared with that in the above-mentioned experimental example 5. On the other hand, when the value of M/(P·Ds) was less than 0.10, the weight of the scattered toners was rapidly increased, as in the above-mentioned experimental example 5.

EXPERIMENTAL EXAMPLE 7

Also in this experimental example, the same carriers and toners as those in the above-mentioned experimental examples 5 and 6 were used. A developer containing 20% by weight of toners and having a bulk density of 0.94 g/cm$^3$ which was obtained by mixing the carriers and the toners was used.

In this experimental example, a distance Ds between the developing sleeve 11 and the photoreceptor 2 which are opposite to each other in the developing region was set to 0.3 mm, and an amount per unit area of the developer 1 conveyed to the developing region by the developing sleeve 11 was adjusted to 8.5 mg/cm$^2$ and 2.9 mg/cm$^2$, to adjust a value of M/(P·Ds1) to 0.30 and 0.10 as shown in the following Tables 8 and 9.

In this experimental example, the photoreceptor 2 was so charged that an initial surface potential V0 at the photoreceptor 2 is −450 V under the respective conditions of the value of M/(P·Ds), that is, 0.30 to 0.10 as described above, and the surface of the photoreceptor 2 was exposed. Further, the peripheral speed of the developing sleeve 11 was set to 1.4 times the peripheral speed of the photoreceptor 2, and a developing bias voltage obtained by superimposing an AC pulse voltage having a duty ratio (development:recovery) of 1:1 and having a peak-to-peak value Vp−p of 1.4 kV on a DC voltage Vb was applied from the developing bias power supply 12. Also in this experimental example, the AC power voltage having a duty ratio (development:recovery) of 1:1 was used as an AC voltage applied from the developing bias power supply 12, whereby a center voltage Vc which is a value obtained by dividing a time integral value of a voltage waveform of the developing bias voltage by the period of the developing bias voltage and the DC voltage Vb coincide with each other (Vc=Vb).

In applying the developing bias voltage obtained by superimposing the DC voltage Vb and the AC voltage from the developing bias power supply 12 as described above, the DC voltage Vb applied from the developing bias power supply 12 was changed, and a voltage difference |Vir−Vc| (hereinafter referred to as ΔV) between a surface potential Vir at an exposed portion of the photoreceptor 2 and the center voltage Vc (=Vb) was changed in the range of 150 to 600 V, to adjust a value of ΔV/Ds as shown in the following Tables 8 and 9. Further, the frequency f of the AC voltage applied from the developing bias power supply 12 was changed in the range of 1.8 to 4.5 kHz, to adjust a value of ΔV/(Ds·f$^2$) as shown in the following Tables 8 and 9, to carry out reverse development. An edge effect and an image density in a formed image were evaluated. The results in a case where the value of M/(P·Ds) is 0.30 are shown in Table 8, and the results in a case where the value of M/(P·Ds) is 0.10 are shown in the Table 9.

In the Tables 8 and 9, with respect to the edge effect, a reflection density b of an image in an edge portion and a reflection density a of an image in a portion other than the edge portion were measured. The edge effect is indicated by R5 in a case where a value of b/a representing the density ratio is less than 1.30 and a density difference therebetween is small, R4 in a case where the value of b/a is 1.31 to 1.40, R3 in a case where the value of b/a is 1.41 to 1.50, R2 in a case where the value of b/a is 1.51 to 1.60, and R1 in a case where the value of b/a is not less than 1.61 and a density difference therebetween is large.

Furthermore, with respect to the image density, a case where an image density (ID) in the obtained image is not less than 1.1 is indicated by ○, and a case where it is less than 1.1 is indicated by x.

TABLE 8

| M/(P · Ds) | ΔV/Ds × $10^{-3}$ | 1/f$^2$ × 10 | ΔV/(Ds · f$^2$) | edge effect | density |
|---|---|---|---|---|---|
| 0.30 | 0.5 | 0.5 | 25 | R4 | x |
| | | 1.0 | 50 | R3 | ○ |
| | | 2.0 | 100 | R3 | ○ |
| | | 3.0 | 150 | R3 | ○ |
| | 1.0 | 0.5 | 50 | R3 | ○ |
| | | 1.0 | 100 | R3 | ○ |
| | | 2.0 | 200 | R2 | ○ |
| | | 3.0 | 300 | R2 | ○ |
| | 1.5 | 0.5 | 75 | R3 | ○ |
| | | 1.0 | 150 | R3 | ○ |

TABLE 8-continued

| M/(P · Ds) | ΔV/Ds × $10^{-3}$ | $1/f^2 \times 10$ | ΔV/(Ds · $f^2$) | edge effect | density |
|---|---|---|---|---|---|
| | | 2.0 | 300 | R2 | ○ |
| | | 3.0 | 450 | R1 | ○ |
| | 2.0 | 0.5 | 100 | R3 | ○ |
| | | 1.0 | 200 | R2 | ○ |
| | | 2.0 | 400 | R1 | ○ |
| | | 3.0 | 600 | R1 | ○ |

TABLE 9

| M/(P · Ds) | ΔV/Ds × $10^{-3}$ | $1/f^2 \times 10$ | ΔV/(Ds · $f^2$) | edge effect | density |
|---|---|---|---|---|---|
| 0.10 | 0.5 | 0.5 | 25 | R4 | x |
| | | 1.0 | 50 | R3 | ○ |
| | | 2.0 | 75 | R3 | ○ |
| | | 3.0 | 150 | R3 | ○ |
| | 1.0 | 0.5 | 50 | R3 | ○ |
| | | 1.0 | 100 | R3 | ○ |
| | | 2.0 | 200 | R2 | ○ |
| | | 3.0 | 300 | R2 | ○ |
| | 1.5 | 0.5 | 75 | R3 | ○ |
| | | 1.0 | 150 | R3 | ○ |
| | | 2.0 | 300 | R2 | ○ |
| | | 3.0 | 450 | R1 | ○ |
| | 2.0 | 0.5 | 100 | R3 | ○ |
| | | 1.0 | 200 | R2 | ○ |
| | | 2.0 | 400 | R1 | ○ |
| | | 3.0 | 600 | R1 | ○ |

As a result, when the value of $\Delta V/(Ds \cdot f^2)$ was less than 50, an image having a sufficient image density was not obtained. On the other hand, when the value of $\Delta V/(Ds \cdot f^2)$ was more than 150, the edge effect in an end of the formed image was increased. Therefore, the end of the image was thickened, and the image density in only the end was increased, whereby the reproduction of a highly precise image was degraded.

Contrary to this, when the development was carried out under the condition of $50 \leqq \Delta V/(Ds \cdot f^2) \leqq 150$ as shown in the present invention, an image having a sufficient image density was obtained, and the edge effect in the end of the formed image was small, whereby the reproduction of a highly precise image was good.

EXPERIMENTAL EXAMPLE 8

Also in this experimental example, the same carriers and toners as those in the above-mentioned experimental examples 5 to 7 were used. A developer containing 20% by weight of toners and a having a bulk density of 0.94 g/$cm^3$ which was obtained by mixing the carriers and the toners was used.

In this experimental example, a distance Ds between the developing sleeve 11 and the photoreceptor 2 which are opposite to each other in the developing region was set to 0.3 mm, and an amount per unit area of the developer 1 conveyed to the developing region by the developing sleeve 11 was adjusted to 8.5 mg/$cm^2$ and 2.9 mg/$cm^2$, to adjust a value of M/(P·Ds) to 0.30 and 0.10 as shown in the following Table 10.

In this experimental example, the photoreceptor 2 was so charged that an initial surface potential V0 at the photoreceptor 2 is +450 V under the respective conditions of the value of M/(P·Ds), that is, 0.30 and 0.10 as described above, and the surface of the photoreceptor 2 was exposed so that a surface potential Vir at an exposed portion of the photoreceptor 2 would be +100 V. Further, the peripheral speed of the developing sleeve 11 was set to 1.4 times the peripheral speed of the photoreceptor 2, and a developing bias voltage obtained by superimposing an AC pulse voltage having a duty ratio (development:recovery) of 1:3 and having a peak-to-peak value Vp−p of 1.4 kV on a DC voltage Vb was applied from the developing bias power supply 12.

In applying the developing bias voltage obtained by superimposing the DC voltage Vb and the AC voltage from the developing bias power supply 12 as described above, the DC voltage Vb applied from the developing bias power supply 12 was changed, a center voltage Vc which is a value obtained by dividing a time integral value of a voltage waveform of the developing bias voltage by the period of the developing bias voltage was adjusted to +300 V and +150 V, and a voltage difference |V0−Vc| (hereinafter referred to as δV) between an initial surface potential V0 at the photoreceptor 2 and the center voltage Vc was set to 150 V and 300 V, to change a value of δV/Ds as shown in the following Table 10. Further, the frequency f of the AC voltage applied from the developing bias power supply 12 was changed in the range of 1.8 to 4.5 kHz, to adjust a value of $\delta V/(Ds \cdot f^2)$ as shown in the following Table 10, to carry out regular development. An edge effect and an image density in a formed image were evaluated in the same manner as that in the above-mentioned experimental example 7. The results are also shown in the Table 10.

TABLE 10

| M/(P · Ds) | ΔV/Ds × $10^{-3}$ | $1/f^2 \times 10$ | ΔV/(Ds · $f^2$) | edge effect | density |
|---|---|---|---|---|---|
| 0.30 | 0.5 | 0.5 | 25 | R3 | x |
| | | 1.0 | 50 | R3 | ○ |
| | | 2.0 | 100 | R3 | ○ |
| | | 3.0 | 150 | R3 | ○ |
| | 1.0 | 0.5 | 50 | R3 | ○ |
| | | 1.0 | 100 | R3 | ○ |
| | | 2.0 | 200 | R2 | ○ |
| | | 3.0 | 300 | R1 | ○ |
| 0.10 | 0.5 | 0.5 | 25 | R3 | x |
| | | 1.0 | 50 | R3 | ○ |
| | | 2.0 | 75 | R3 | ○ |
| | | 3.0 | 150 | R3 | ○ |
| | 1.0 | 0.5 | 50 | R3 | ○ |
| | | 1.0 | 100 | R3 | ○ |
| | | 2.0 | 200 | R2 | ○ |
| | | 3.0 | 300 | R1 | ○ |

As a result, also in this experimental example B, when the value of $\delta V/(Ds \cdot f^2)$ was less than 50 as in the above-mentioned experimental example 7, an image having a sufficient image density was not obtained. On the other hand, when the value of $\delta V/(Ds \cdot f^2)$ was more than 150, the edge effect in an end of the formed image was increased. Therefore, the end of the image was thickened, and the image density in only the end was increased, whereby the reproduction of a highly precise image was degraded.

Contrary to this, when the development was carried out under the condition of $50 \leqq \delta V/(Ds \cdot f^2) \leqq 150$ as shown in the present invention, an image having a sufficient image density was obtained, and the edge effect in the end of the formed image was small, whereby the reproduction of a highly precise image was good.

EXPERIMENTAL EXAMPLE 9

Also in this experimental example, the same carriers and toners as those in the above-mentioned examples 5 to 8 were used. A developer containing 10% by weight of toners which was obtained by mixing the carriers and the toners was used.

In this experimental example, in carrying out development using the above-mentioned developing device 10, the peripheral speed of the developing sleeve 11 was set to two times the peripheral speed of the photoreceptor 2. Further, an initial surface potential V0 at the photoreceptor 2 was set to −450 V, a surface potential Vir at an exposed portion of the photoreceptor 2 was set to −100 V, a distance Ds between the developing sleeve 11 and the photoreceptor 2 which are opposite to each other in the developing region was set to 0.3 mm, and the amount of the developer conveyed by the developing sleeve 11 was set to 4.0 mg/cm$^2$. A developing bias voltage obtained by superimposing an AC pulse voltage having a duty ratio (development:recovery) of 1:1 and having a peak-to-peak value Vp−p of 1.2 kV on a DC voltage Vb of −350 V was applied from the developing bias power supply 12. On the other hand, the peripheral speed Vs of the photoreceptor 2 was changed in the range of 200 to 1000 mm/s, and the frequency f of the AC voltage applied from the developing bias power supply 12 was changed in the range of 1 to 11 kHz, as shown in the following Table 11, to carry out reversal development.

The state of a background fog in an image formed upon changing the conditions of the peripheral speed Vs of the photoreceptor 2 and the frequency f of the AC voltage applied from the developing bias power supply 12 was examined. The results are shown in the Table 11. In the Table 11, a case where the background of the image is not fogged is indicated by ○, and a case where the background of the image is fogged is indicted by x.

TABLE 11

| Vs | f(kHz) | | | | | | | | | | |
|---|---|---|---|---|---|---|---|---|---|---|---|
| (mm/s) | 1 | 2 | 3 | 4 | 5 | 6 | 7 | 8 | 9 | 10 | 11 |
| 200 | X | X | ○ | ○ | ○ | ○ | ○ | ○ | ○ | ○ | ○ |
| 300 | X | X | X | ○ | ○ | ○ | ○ | ○ | ○ | ○ | ○ |
| 400 | X | X | X | X | ○ | ○ | ○ | ○ | ○ | ○ | ○ |
| 500 | X | X | X | X | X | ○ | ○ | ○ | ○ | ○ | ○ |
| 600 | X | X | X | X | X | X | ○ | ○ | ○ | ○ | ○ |
| 700 | X | X | X | X | X | X | X | ○ | ○ | ○ | ○ |
| 800 | X | X | X | X | X | X | X | X | ○ | ○ | ○ |
| 900 | X | X | X | X | X | X | X | X | X | ○ | ○ |
| 1000 | X | X | X | X | X | X | X | X | X | X | ○ |

As a result, in the relationship between the peripheral speed Vs(mm/s) of the photoreceptor 2 and the frequency f (kHz) of the AC voltage applied from the developing bias power supply 12, it was preferable to satisfy the condition of Vs (mm/s)/f (kHz)<100 in terms of prevention of the background fog.

EXPERIMENTAL EXAMPLE 10

In this experimental example, in carrying out development using the above-mentioned developing device 10, the amount of the developer 1 conveyed by the developing sleeve 11 was set to 4.6 mg/cm$^2$, the peripheral speed θ2 of the photoreceptor 2 was set to 165 mm/s, the ratio θ (=θ1/θ2) of the peripheral speed θ1 of the developing sleeve 11 to the peripheral speed θ2 of the photoreceptor 2 was set to 1.8, an initial surface potential V0 at the photoreceptor 2 was set to −450 V, a surface potential Vir at an exposed portion of the photoreceptor 2 was set to −100 V, and a distance Ds between the photoreceptor 2 and the developing sleeve 11 which are opposite to each other in the developing region was set to 0.3 mm. A developing bias voltage obtained by superimposing an AC pulse voltage having a frequency of 3 kHz and having a peak-to-peak value Vp−p of 1.4 kV on a DC voltage vb of −350 v was applied as a developing bias voltage from the developing bias power supply 12.

As carriers in the developer 1, nine types of binder-type carriers each containing 500 parts by weight of magnetic powder per 100 parts by weight of binder resin and respectively having particle diameters shown in the following Table 12 were used, and a coating rate A (%) at which the surface of the developing sleeve 11 is coated with the magnetic brush formed of the developer 1 using the carriers in the developing region was changed as shown in the Table 12. The texture of a formed image and the scattering of toners in the developer 1 at the time of the development were examined. The results are shown in the Table 12.

In the Table 12, with respect to the texture of the formed image, a case where the texture is very smooth is indicated by ⊙, a case where it is slightly smooth is indicated by ○, a case where it is coarse is indicated by Δ, and a case where it is very coarse is indicated by x. Further, with respect to the scattering of the toners, a case where no toners are scattered is indicated by ⊙, a case where few toners are scattered is indicated by ○, and a case where toners are scattered is indicated by Δ, and a case where a lot of toners are scattered is indicated by x.

TABLE 12

| particle diameter of carrier (μm) | coating rate (%) | texture | scattering of toner |
|---|---|---|---|
| 100 | 8 | X | ⊙ |
| 90 | 10 | Δ | ⊙ |
| 70 | 15 | ○ | ⊙ |
| 60 | 26 | ○ | ⊙ |
| 25 | 36 | ○ | ○ |
| 16 | 40 | ⊙ | ○ |
| 12 | 45 | ⊙ | ○ |
| 9 | 50 | ⊙ | Δ |
| 7 | 55 | ⊙ | x |

As a result, in a case where the developer 1 was introduced into the developing region opposite to the photoreceptor 2 in the state of the magnetic brush by the developing sleeve 11, when the development was carried out in such a manner that the coating rate A at which the surface of the developing sleeve 11 is coated with the magnetic brush formed of the developer 1 is in the range shown in the present invention, no toners were scattered, so that a good image of fine texture was obtained. Contrary to this, when the coating rate A was not more than 10%, the texture of the formed image were coarser. On the other hand, when the coating rate A was not less than 50%, more toners were scattered.

EXPERIMENTAL EXAMPLE 11

In this experimental example, development was carried out in the same manner as that in the above-mentioned experimental example 10 except that the types of the carriers in the above-mentioned experimental example 10 were changed, to use four types of binder-type carriers containing magnetic powder in ratios (parts by weight) shown in the following table 13 per 100 parts by weight of binder resin and having a particle diameter of 25 μm, and a coating rate A (%) at which the surface of the developing sleeve 11 is coated with the magnetic brush formed of the developer 1 using the carriers in the developing region was changed as shown in the Table 13, The texture of a formed image and the scattering of toners in the developer 1 at the time of the development were examined. The results are shown in the Table 13.

TABLE 13

| amount of magnetic powder (μm) | coating rate (%) | texture | scattering of toner |
|---|---|---|---|
| 500 | 36 | ○ | ○ |
| 400 | 42 | ◎ | ○ |
| 200 | 49 | ◎ | ○ |
| 100 | 55 | ◎ | x |

As a result, in a case where the development was carried out in such a manner that the coating rate A at which the surface of the developing sleeve 11 is coated with the magnetic brush formed of the developer 1 in the developing region is less than 50, as in the above-mentioned experimental example 10, no toners were scattered, so that a good image of fine texture was obtained.

EXPERIMENTAL EXAMPLE 12

In this experimental example, a developer containing 10% by weight of toners which was obtained by mixing binder-type carriers and toners was used.

In conveying the developer 1 to the developing region opposite to the photoreceptor 2 in the sate of the magnetic brush by the developing sleeve 11 in the developing device 10 and supplying toners T in the developer 1 from the developing sleeve 11 to the photoreceptor 2 in the developing region to carry out development, the development was carried out in the same manner as that in the above-mentioned experimental example 10 except that the number of bristles N (/mm$^2$) of the magnetic brush formed of the developer 1 which exist per unit area on the surface of the developing sleeve 11 and the ratio θ (=θ1/θ2) of the peripheral speed θ1 of the developing sleeve 1 to the peripheral speed θ2 of the photoreceptor 2 were changed as shown in the following Table 14, to change the relative number of bristles N·θ (/mm$^2$) of the magnetic brush per unit area of the photoreceptor 2. The texture of an image formed under each of the conditions and the scattering of the toners at the time of the development were examined. The results are shown in the Table 14.

TABLE 14

| N · θ (/mm$^2$) | θ | N · θ (/mm$^2$) | texture | scattering of toner |
|---|---|---|---|---|
| 5 | 1 | 5 | Δ | ◎ |
| 9 | 1 | 9 | ◎ | ◎ |
| 9 | 2.8 | 25.2 | ◎ | ◎ |
| 18 | 1.8 | 32.4 | ◎ | ○ |
| 24 | 1.8 | 43.2 | ◎ | ○ |
| 30 | 2.8 | 84 | ◎ | ○ |
| 30 | 3 | 90 | ◎ | ○ |
| 32 | 2.8 | 92.4 | ◎ | Δ |
| 50 | 2.8 | 140 | ◎ | x |

As a result, when the development was carried out under the condition that the relative number of bristles N·θ of the magnetic brush per unit area of the photoreceptor 2 is less than 9/mm$^2$, the texture of the formed image was coarse. Contrary to this, when the development was carried out on the condition that the value of N·θ is more than 90/mm$^2$, more toners are scattered. On the other hand, when the development was carried out on the condition that the value of N·θ is in the range of 9 to 90/mm$^2$, few toners were scattered, whereby a fine-textured and highly precise image was obtained.

EXPERIMENTAL EXAMPLE 13

In this experimental example, a developer containing 10% by weight of toners which was obtained by mixing binder-type carriers and toners was used.

In conveying the developer 1 to the developing region opposite to the photoreceptor 2 in the sate of the magnetic brush by the developing sleeve 11 in the developing device 10 and supplying toners T in the developer 1 from the developing sleeve 11 to the photoreceptor 2 in the developing region to carry out development, the development was carried out in the same manner as that in the above-mentioned experimental example 10 except that letting h (mm) be the average height of the magnetic brush formed of the developer 1 on the surface of the developing sleeve 1, and A2 (mm$^2$) be the area of a potion, where the bristles of the magnetic brush formed of the developer 1 do not exist, per square millimeter on the surface of the developing sleeve 11, a value of h·A2 (mm$^3$) was changed as shown in the following Table 15. The texture of an image formed under each of the conditions and the scattering of the toners at the time of the development were examined. The results are shown in the Table 15.

TABLE 15

| h · A2 (mm$^3$) | 0.13 | 0.15 | 0.17 | 0.32 | 0.52 | 0.59 | 0.60 | 0.64 |
|---|---|---|---|---|---|---|---|---|
| texture | ◎ | ◎ | ◎ | ◎ | ◎ | ◎ | Δ | X |
| scattering of toner | X | Δ | ◎ | ◎ | ◎ | ◎ | ◎ | ◎ |

As a result, when the development was carried out under the condition that the value of h·A2 is not more than 0.15 mm$^3$, the toners were scattered at the time of the development. On the other hand, when the development was carried out under the condition that the value is not less than 0.60 mm$^3$, the texture of the formed image was coarser, whereby the reproduction of a highly precise image was degraded.

Contrary to this, when the development was carried out in such a manner that the value h·A2 is in the range of 0.15 mm$^3$<h·A2<0.60 mm$^3$, few toners were scattered at the time of the development, whereby a fine-textured and highly precise image was obtained.

Although the present invention has been fully described by way of examples with reference to the accompanying drawings, it is to be noted that various changes and modifications will be apparent to those skilled in the art.

Therefore, unless otherwise such changes and modifications depart from the scope of the present invention, they should be constructed as being included therein.

What is claimed is:

1. A reversal developing method of exposing the surface of a charged image carrying member to light to form an electrostatic latent image on the surface of the image carrying member, while conveying a developer containing toners and carriers to a developing region opposite to the image carrying member having the electrostatic latent image formed thereon in a state of a magnetic brush by a developer conveying member in such a way that the toners adhere to the light exposed area of the charged image carrying member, said method comprising the steps of:

applying an oscillating developing bias voltage between the image carrying member and the developer conveying member, supplying the toners in the developer from the developer conveying member to the image carrying member in the developing region, to carry out development of the electrostatic latent image, and carrying out the development in such a manner that the relationship among an amount per unit area M (mg/cm$^2$) of the developer conveyed to the developing region by said developer conveying member, the bulk density P of said developer, and a distance Ds (mm) between the developer conveying member and the image carrying member which are opposite to each other in the developing region satisfies the following conditions:

$$0.10 \leqq M/(P \cdot Ds) \leqq 0.30 \text{ and}$$

$$300\ \text{V} \leqq \Delta V \leqq 600\ \text{V}$$

wherein ΔV is |Vir−Vc| and Vc is a value between V0 and Vir, said Vc being a center voltage a value of which is obtained by dividing a time integral value of a voltage wave form of said oscillating developing bias voltage by a period of said oscillating developing bias voltage, said Vir being a surface potential at an exposed portion of the image carrying member, and said V0 being an initial surface potential at the charged image carrying member.

2. The developing method according to claim 1, wherein binder-type carriers containing magnetic powder in binder resin are used as the carriers, and the average particle diameter thereof is 10 to 50 μm.

3. The developing method according to claim 1, wherein the magnetic force of the carriers is 800 to 3000 Gauss.

4. The developing method according to claim 1, wherein said developer conveying member contains a development magnetic pole inside thereof in the developing region, and when r (μm) is the average particle diameter of the carriers, Bc (Gauss) is a magnetic force of the carriers, and Bm (Gauss) is a magnetic force of the development magnetic pole in the developer conveying member, the following condition is satisfied:

$$7 \times 10^8 \leqq r^3 \cdot Bc \cdot Bm \leqq 2 \times 10^{11}.$$

5. The developing method according to claim 1, wherein said development in said developing region to carry out reversal development further satisfies the following condition:

where f is the frequency (kHz) of said oscillating developing bias voltage.

6. A reversal developing method, which is defined as a development where toners adhere to the light exposed area of a charged image carrying member, comprising the steps of:

exposing the charged image carrying member to light in an image wise pattern to prepare an electrostatic latent image thereon;

conveying a developer held on a developer conveying member to a developing region opposite to the image carrying member in the state of a magnetic brush; and applying an oscillating developing bias voltage between the image carrying member and the developer conveying member to develop the electrostatic latent image formed on the charged image carrying member;

said steps being carried out in such a manner that the relationship among an amount per unit area M (mg/cm$^2$) of the developer conveyed to the developing region by said developer conveying member, the bulk density P of said developer, and a distance Ds (mm) between the developer conveying member and the image carrying member which are opposite to each other in the developing region satisfies the following conditions:

$$0.10 \leqq M/(P \cdot Ds) \leqq 0.30 \text{ and}$$

$$300\ \text{V} \leqq \Delta V \leqq 600\ \text{V}$$

wherein ΔV is |Vir−Vc| and Vc is a value between V0 and Vir, said Vc being a center voltage a value of which is obtained by dividing a time integral value of a voltage wave form of said oscillating developing bias voltage by a period of said oscillating developing bias voltage, said Vir being a surface potential at an exposed portion of the image carrying member, and said V0 being an initial surface potential at the charged image carrying member.

7. The developing method according to claim 6, wherein said development in said developing region to carry out reversal development further satisfies the following condition:

$$50 \leqq |Vir - Vc|/(Ds \cdot f^2) \leqq 150$$

where f is the frequency (kHz) of said oscillating developing bias voltage.

* * * * *